US011629447B2

(12) United States Patent
Kim et al.

(10) Patent No.: US 11,629,447 B2
(45) Date of Patent: Apr. 18, 2023

(54) DRUM-TYPE WASHING APPARATUS

(71) Applicant: Samsung Electronics Co., Ltd., Suwon-si (KR)

(72) Inventors: Yongkwon Kim, Suwon-si (KR); Zoohyeong Kim, Suwon-si (KR); Eungryeol Seo, Suwon-si (KR); Jihoon Choi, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 272 days.

(21) Appl. No.: 16/999,283

(22) Filed: Aug. 21, 2020

(65) Prior Publication Data

US 2021/0054555 A1 Feb. 25, 2021

(30) Foreign Application Priority Data

Aug. 23, 2019 (KR) ..... 10-2019-0103436

(51) Int. Cl.

| | |
|---|---|
| ***D06F 37/04*** | (2006.01) |
| ***D06F 23/02*** | (2006.01) |
| ***D06F 37/22*** | (2006.01) |

(52) U.S. Cl.

CPC ..... *D06F 37/04* (2013.01); *D06F 23/02* (2013.01); *D06F 37/22* (2013.01)

(58) Field of Classification Search

CPC ..... D06F 37/04

See application file for complete search history.

(56) References Cited

U.S. PATENT DOCUMENTS

| | | | |
|---|---|---|---|
| 8,181,355 | B2 | 5/2012 | Geyer et al. |
| 2015/0252512 | A1 | 9/2015 | Jeon et al. |
| 2019/0071811 | A1 | 3/2019 | Lee et al. |

FOREIGN PATENT DOCUMENTS

| | | | |
|---|---|---|---|
| CN | 101845739 | A | 9/2010 |
| EP | 2 719 808 | A1 | 4/2014 |
| EP | 2 372 010 | B1 | 9/2016 |
| EP | 3 412 823 | A1 | 12/2018 |
| KR | 2003-0004554 | A | 1/2003 |
| KR | 10-2018-0007308 | A | 1/2018 |
| KR | 10-1962253 | B1 | 3/2019 |
| WO | WO 2018/012852 | A1 | 1/2018 |

OTHER PUBLICATIONS

International Search Report dated Nov. 27, 2020, in corresponding International Patent Application No. PCT/KR2020/011124.

Supplementary European Search Report dated May 23, 2022, in European Application No. 20857713.0.

*Primary Examiner* — Jason Y Ko

(74) *Attorney, Agent, or Firm* — Staas & Halsey LLP

(57) ABSTRACT

A drum-type washing apparatus includes: a housing including a door in a front thereof to be opened and closed; and a washing tub supported to spin inside the housing, having a cylindrical shape opened toward the door to accommodate laundry therein, and including a pattern on which a plurality of dewatering holes for discharging wash water are arranged on an inner circumferential surface thereof, the pattern including: a first pattern including an even area provided at least one side of a first dewatering hole along the inner circumferential surface, and a second pattern provided at least one side of a second dewatering hole different from the first dewatering hole along the inner circumferential surface and including an uneven area having lower flatness than the even area.

18 Claims, 16 Drawing Sheets

DRUM-TYPE WASHING APPARATUS

CROSS-REFERENCE TO RELATED THE APPLICATION

This application is based on and claims priority under 35 U.S.C. § 119 to Korean Patent Application No. 10-2019-0103436 filed on Aug. 23, 2019 in the Korean Intellectual Property Office, the disclosure of which is incorporated by reference herein in its entirety.

BACKGROUND

Field

The disclosure relates to a drum-type washing apparatus with a washing tub shaped like a drum and spinning with respect to an axis line substantially parallel with an installation surface, and more particularly to a drum-type washing apparatus having a pattern structure on a surface of a wrapper forming a drum.

Description of the Related Art

A washing apparatus refers to an apparatus that includes a washing tub into which laundry such as cloth, clothes, bedclothes, etc. is loaded, and does the laundry in the washing tub by driving the washing tub to spin with a motor. The washing apparatus may be classified into two of a top-loading type and a front-loading type according to dispositions of the washing tub. In the top-loading washing apparatus, the washing tub substantially vertically disposed and spins with respect to a vertical axis. In a top-loading washing machine, a vertical shaft is connected to the washing tub which is disposed in a substantially vertical direction, and a pulsator is provided inside the washing tub. While the washing, tub of the top-loading washing machine is spinning forward and backward with respect to the vertical shaft, the laundry gets clean based on water flow generated by the pulsator.

On the other hand, the washing tub in the front-loading washing apparatus is disposed substantially horizontally or inclined at a predetermined angle to a horizontal axis. The front-loading washing apparatus may for example include a drum type (front-loading type) washing machine, and a drum type (front-loading type) drying machine. While the washing tub of the front-loading washing machine is spinning forward and backward with respect to a horizontal shaft, laundry gets clean based on collision due to a fall as the laundry is lifted up along the inner circumferential surface of the washing tub and then falls.

The washing tub for the front-loading type is shaped like a cylinder opened frontward, and also called a drum. The drum is manufactured by rolling an oblong and thin wrapper made of stainless steel into a drum shape and welding the sides thereof. The wrapper includes a plurality of dewatering holes through which water is drained from the inside of the wrapper to the outside of the wrapper during a washing process. Further, a washing efficiency is relatively low when the wrapper has a smooth surface, and therefore the wrapper is formed with a continuous pattern to improve the washing efficiency.

However, the dewatering hole is formed to pass through the surface of the wrapper and thus lowers the rigidity of the wrapper. If the number of dewatering holes is reduced throughout the wrapper, the rigidity of the wrapper is guaranteed but a dewatering efficiency is relatively lowered.

Further, the continuous pattern structure formed on the wrapper in addition to such a structure of the dewatering hole causes the rigidity of the wrapper to be further lowered while the front-loading washing machine is operating. In a washing process or a dewatering process, centrifugal force is caused by the laundry inside the spinning drum and acts on the patterned shape of the wrapper, and thus the wrapper is easily deformed. As revolutions per minute (RPM) of the drum become higher and the amount of laundry loaded into the drum increases, the deformation is highly likely to be generated in the pattern of the wrapper.

Accordingly, there may be needed a structure for reinforcing the rigidity of the wrapper so far as possible without lowering the dewatering efficiency and the washing efficiency in the front-loading washing apparatus.

SUMMARY

According to an embodiment of the disclosure, there is provided a drum-type washing apparatus including: a housing including a door in a front, thereof to be opened and closed; and a washing tub supported to spin inside the housing, having a cylindrical shape opened toward the door to accommodate laundry therein, and including a pattern on which a plurality of dewatering holes for discharging wash water are arranged on an inner circumferential surface thereof, the pattern including: a first pattern including an even area provided at least one side of a first dewatering hole along the inner circumferential surface, and a second pattern provided at least one side of a second dewatering hole different from the first dewatering hole along the inner circumferential surface and including an uneven area having lower flatness than the even area.

An area formed with the dewatering hole in the washing tub may be more recessed toward an outer circumference of the washing tub than the even area or the uneven area.

The first dewatering hole or the second dewatering hole may be provided in plural on the recessed area in a direction parallel with a spinning axis of the washing tub.

The uneven area may protrude toward a spinning axis of the washing tub.

The uneven area protruding from the inner circumferential surface may be higher than the even area.

The first pattern and the second pattern may be alternately provided along the inner circumferential surface.

The first pattern or the second pattern may be arranged in a spinning axial direction of the washing tub.

The first pattern or the second pattern may be arranged as inclined in a spinning direction of the washing tub.

The plurality of dewatering holes may further include a third dewatering hole spaced apart from the first dewatering hole or the second dewatering hole in a direction parallel with a spinning axis of the washing tub.

The even area and the uneven area may be adjacent to each other.

The plurality of dewatering holes may further include a fourth dewatering hole provided between the even area and the uneven area.

The even areas or the uneven areas may be provided at opposite sides of the first dewatering hole or the second dewatering hole.

BRIEF DESCRIPTION OF THE DRAWINGS

The above and/or other aspects will become apparent and more readily appreciated from the following description of embodiments, taken in conjunction with the accompanying drawings, in which.

DETAILED DESCRIPTION OF EMBODIMENTS

Below, embodiments will be described in detail with reference to accompanying drawings. Further, the embodiments described with reference to the accompanying drawings are not exclusive to each other unless otherwise mentioned, and a plurality of embodiments may be selectively combined within one apparatus. The combination of these plural embodiments may be discretionally selected and applied to realize the present inventive concept by a person having an ordinary skill in the art.

In the description of the embodiments, an ordinal number used in terms such as a first element, a second element, etc. is employed for describing variety of elements, and the terms are used for distinguishing between one element and another element. Therefore, the meanings of the elements are not limited by the terms, and the terms are also used just for explaining the corresponding embodiment without limiting the disclosure.

Further, a term "at least one" among a plurality of elements in the disclosure represents not only all the elements but also each one of the elements, which excludes the other elements or all combinations of the elements.

Figure 1:
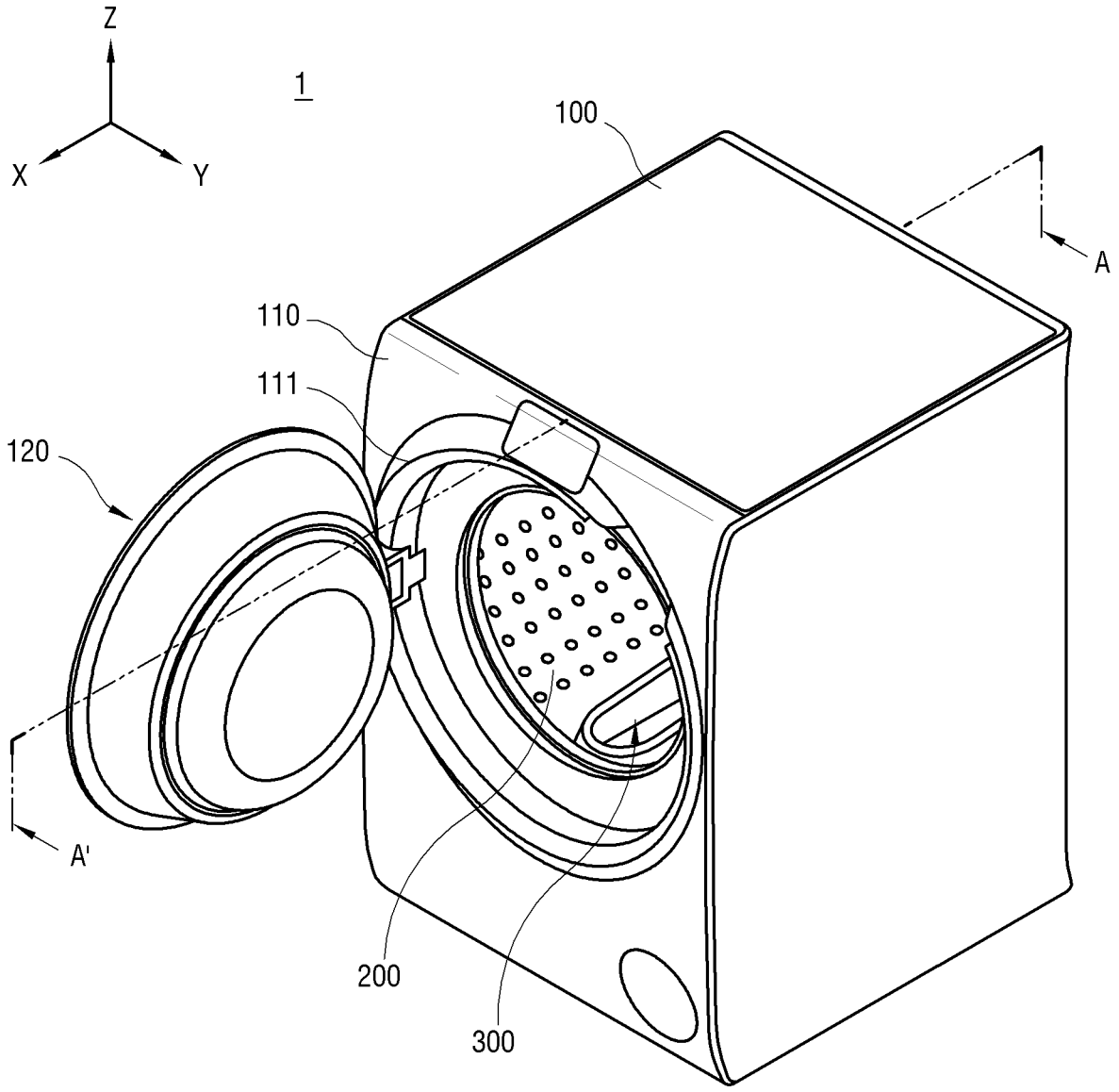
FIG. 1 is a perspective view of a front-loading washing machine.

FIG. 1 is a perspective view of a front-loading washing machine.

As shown in FIG. 1, a front-loading washing apparatus according to an embodiment of the disclosure is embodied by a front-loading washing machine 1. However, the front-loading washing apparatus may be embodied by a front-loading drying machine provided to dry laundry inside a washing tub, as well as the front-loading washing machine 1 according to this embodiment. On the contrary to a top-loading washing machine with a washing tub that spins with respect to a vertical axis line substantially perpendicular to an installation surface, the front-loading washing machine 1 includes a washing tub 200 that spins with respect to a horizontal axis line substantially parallel with the installation surface. However, the spinning axis for the washing tub 200 is not necessarily horizontal, but may be inclined at a predetermined angle to the horizontal axis line. Below, a basic structure of the front-loading washing machine 1 will be described in detail.

In the accompanying drawings, X, Y and Z directions are orthogonal to one another. The X direction refers to a direction toward the front of the front-loading washing machine 1, in which a user is generally positioned to control the front-loading washing machine 1. The Y direction refers to a widthway direction of the front-loading washing machine 1. The Z direction refers to a vertical direction of the front-loading washing machine 1, which is opposite to the direction of gravity. The following descriptions will be based on these directions.

The front-loading washing machine 1 includes a housing 100 forming an outer appearance, the washing tub 200 provided to spin inside the housing 100, and a plurality of lifters 300 protruding from the inner circumferential surface of the washing tub 200 toward a central axis line of the washing tub 200.

The housing 100 has a schematically hexahedral shape, and a front panel 110 of the housing 100 is formed with a loading hole 111 through which laundry is loaded from the outside. The housing 100 includes a door 120 coupled to the front panel 110 so as to selectively open and close the loading hole 111. The door 120 may for example be coupled to the front panel 110 by a hinge, and rotatably provided between a closed position for closing the loading hole 111 and an open position for opening the loading hole 111. Further, the door 120 includes a handle to be gripped by a user to rotate the door 120.

Figure 2:
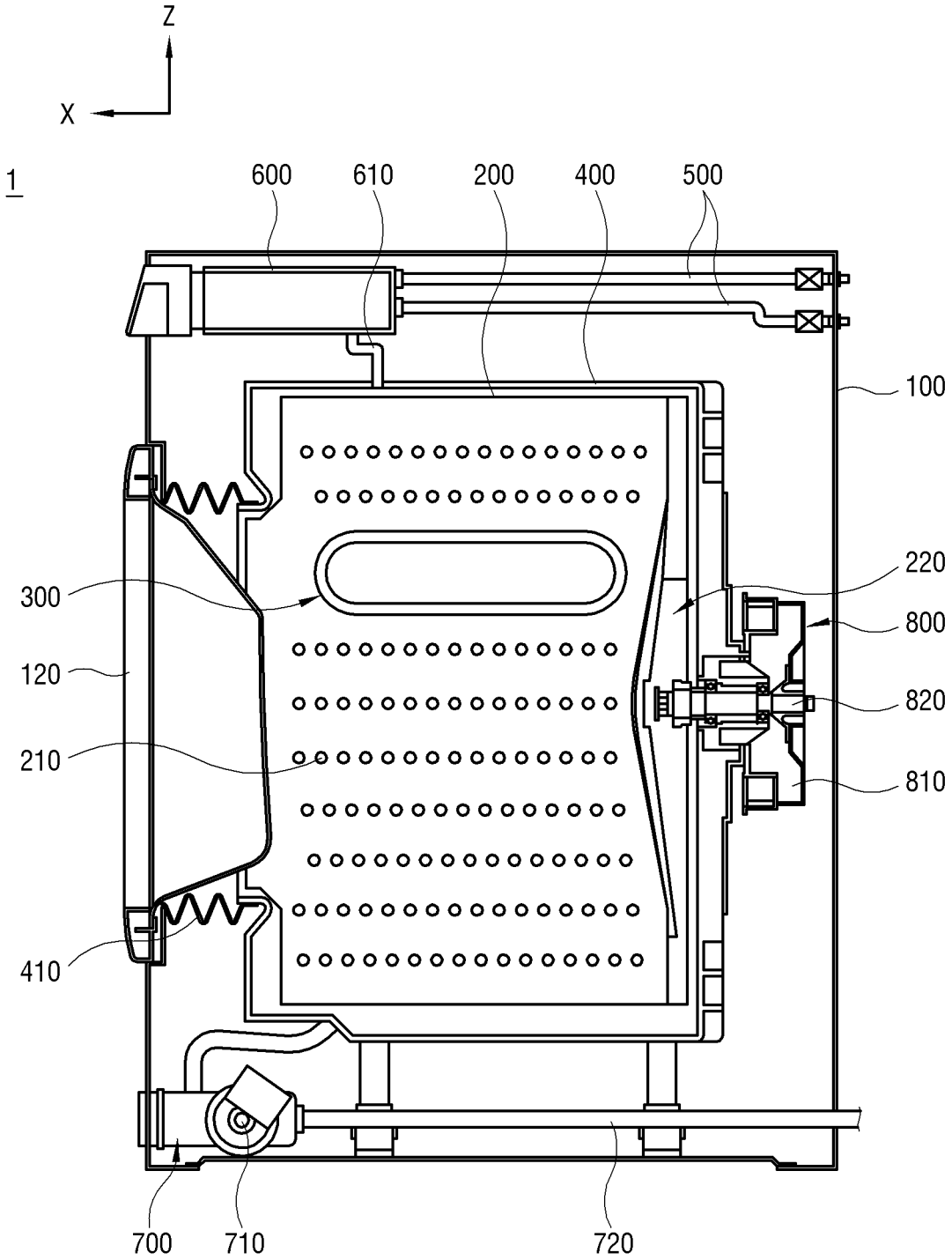
FIG. 2 is a lateral cross-section view of the front-loading washing machine, taken along line A-A' in FIG. 1.

FIG. 2 is a lateral cross-section view of the front-loading washing machine, taken along line A-A' in FIG. 1.

As shown in FIG. 2, the front-loading washing machine 1 includes the housing 100, the washing tub 200, and the lifter 300. The housing 100 includes the door 120 for opening and closing the loading hole.

The front-loading washing machine 1 further includes a water tank 400 to be filled with wash water, a water supplying pipe 500 to supply wash water from an external water source such as a water supply, a detergent supplier 600 to add detergent to the wash water supplied through the water supplying pipe 500, a drainage 700 to drain the wash water from the inside of the water tank 400 to the outside, and a driver 800 to drive the washing tub 200.

Meanwhile, the washing tub 200 is provided to spin inside the water tank 400, and is formed with a loading hole on the front thereof. The loading hole of the washing tub 200 is disposed to be aligned with the loading hole of the housing 100, so that the laundry put through the loading hole of the housing 100 can be loaded into the washing tub 200. The washing tub 200 includes a plurality of dewatering holes 210 formed on and passing through the inner circumferential surface thereof to allow wash water to flow in and out. Through the dewatering hole 210, the inner space of the washing tub 200 communicates with the inner space of the water tank 400. Further, the washing tub 200 includes a rear frame 220 coupled to the driver 800 so that the washing tub 200 can spin based on driving power of the driver 800.

The water tank 400 accommodates the washing tub 200 therein, and is disposed to be horizontal or inclined at a predetermined angle to a horizontal line inside the housing 100 so as to be filled with wash water during a washing process. The water tank 400 includes the loading hole formed on the front thereof facing toward the door 120. The water tank 400 includes a diaphragm 410 interposed between the loading hole of the housing 100 and the loading hole of the water tank 400. The diaphragm 410 prevents wash water in the water tank 400 from leaking, allows position change of the water tank 400, and absorbs vibration of the water tank 400 when the door 120 is in the closing position.

The water supplying pipe 500 serves as a channel for supplying wash water to the water tank 400 and is placed above the water tank 400. The water supplying pipe 500 includes one end connecting and communicating with the external water source, and the other end connecting and communicating with the detergent supplier 600.

The detergent supplier 600 communicates with the water tank 400 through a supplying pipe 610. Water supplied through the water supplying pipe 500 is mixed with detergent via the detergent supplier 600, and the water mixed with the detergent is supplied into the water tank through the supplying pipe 610. The water tank 400 includes a hole with which the water supplying pipe 500 connects and communicates, and the water supplying pipe 500 is coupled to this hole so that wash water can be supplied to the water tank 400.

The drainage 700 is placed below the water tank 400 and drains the wash water from the inside of the water tank 400 to the outside of the housing 100. The drainage 700 includes a drain pump 710 to generate pneumatic pressure to drain the wash water to the outside, and a drain hose 720 connecting and communicating with the drain pump 710 and serving as a channel for wash water from the inside of the water tank 400 to the outside of the housing 100.

The driver 800 is disposed behind the washing tub 200. The driver 800 includes a motor 810 to generate the driving power, and a spinning shaft 820 connecting the motor 810 and the rear frame 220 to transfer the driving power from the motor 810 to the washing tub 200. The driving power generated as the motor 810 rotates forward and backward is transferred to the washing tub 200 through the spinning shaft 820, so that the washing tub 200 spins forward and backward based on the driving power, thereby washing the laundry in the washing tub 200.

The lifter 300 protrudes from the inner circumferential surface of the washing tub 2000 toward the center of the washing tub 200, and a plurality of lifters 300 are spaced apart at predetermined intervals along the inner circumferential surface of the washing tub 200. The lifter 300 lifts the laundry up to a predetermined height in the washing tub 200 as the laundry is caught in the lifter 300 when the washing tub 200 spins, and moves the laundry so that wash water can smoothly flow, thereby improving an effect on washing the laundry.

The lifter 300 is extended to have a predetermined length in a direction parallel with the spinning axis line of the washing tub 200. In other words, the lengthwise direction of the lifter 300 is parallel with the spinning axis line of the washing tub 200. The lifter 300 may have a linear structure of which the width is uniform along the lengthwise direction, a concave structure of which the width in a middle area is narrower than those at opposite ends, or a convex structure of which the width in the middle area is wider than those at the opposite ends.

Figure 3:
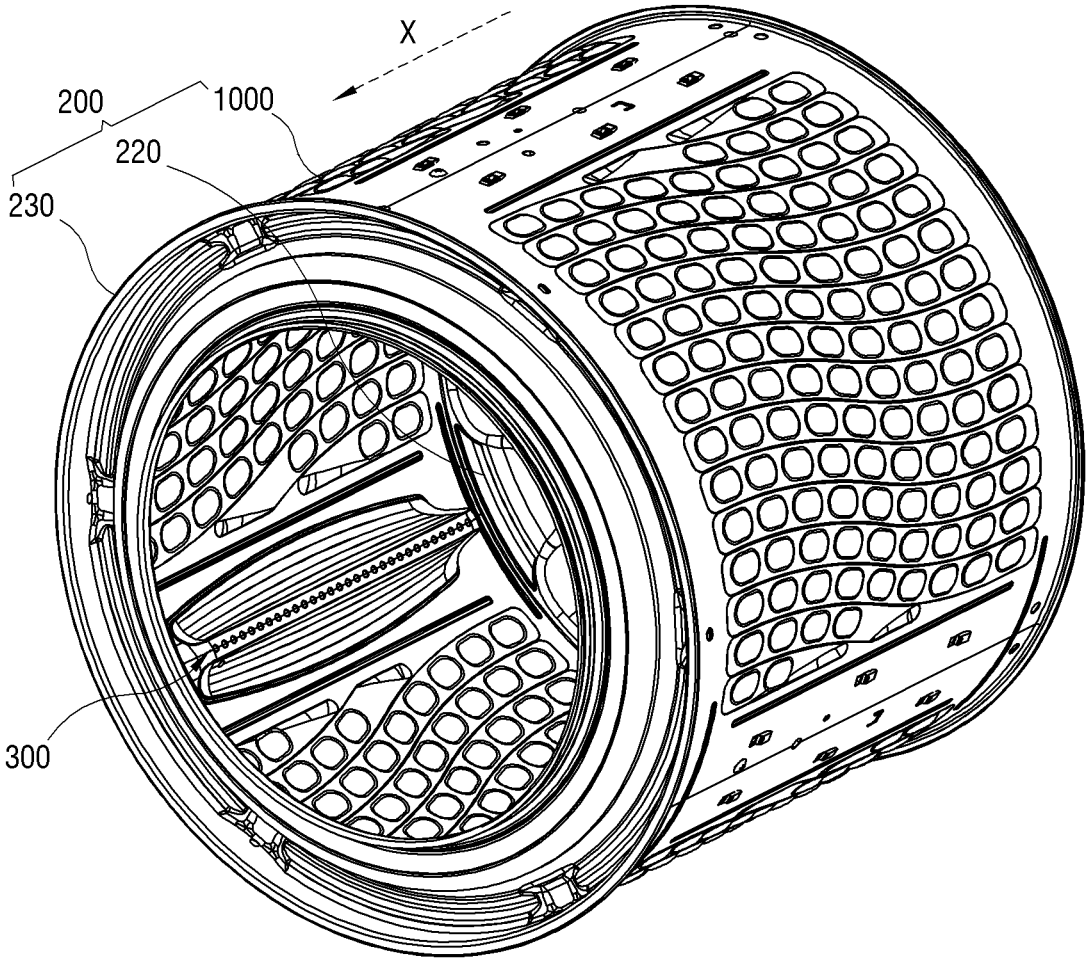
FIG. 3 is a perspective view of a washing tub of a front-loading washing machine.

FIG. 3 is a perspective view of a washing tub of a front-loading washing machine.

As shown in FIG. 3, the washing tub 200 according to an embodiment has a cylindrical shape. The washing tub 200 includes a front frame 230 shaped like a ring with an opening, a rear frame 220 shaped like a disk disposed in parallel with the front frame 230 and having a diameter similar to that of the front frame 230, and a wrapper 1000 forming a wall of the washing tub 200 between the front frame 230 and the rear frame 220.

The opening of the front frame 230 in the front of the washing tub 200 is aligned with the opening of the housing, so that a user can put laundry into or take the laundry out of the washing tub 200. The front frame 230 and the rear frame 220 respectively support the front and rear ends of the rolled wrapper 1000, so that the washing tub 200 can have a cylindrical shape.

The rear frame 220 spins based on the driving power of the driver as its back is connected to the driver. The rear frame 220 couples with the front frame 230 and the wrapper 1000, and therefore the washing tub 200 spins forward and backward based on the deriving power with respect to a predetermined axis line in the X direction. The X direction refers to a direction substantially parallel with an installation surface such as a floor on which the front-loading washing machine is installed, i.e. refers to a horizontal direction. However, the spinning axis line of the washing tub 200 is not necessarily parallel with the axis line of the X direction, but may be inclined at a predetermined angle to the axis line of the X direction.

The wrapper 1000 is manufactured as a rectangular plate having a plurality of dewatering holes is roiled with respect to the spinning axis of the washing tub 200 and its both sides are coupled. The dewatering holes are provided to allow wash water filled in the water tank to flow in and out of the washing tub 200. On the inner circumferential surface of the wrapper 1000, one or more lifters 300 are arranged being extended in the X direction.

The lifters 300 are coupled to the inner circumferential surface of the wrapper 1000, protruding toward the spinning axis of the washing tub 200. The lifter 300 hits and lifts up laundry by the left and right sides of the protruding structure thereof when the washing tub 200 spins. The laundry hit and lifted up by the lifter 300 falls and collides with the wrapper 1000. Such operations are repeated to do the laundry.

Below, the structure of the wrapper 1000 will be described.

Figure 4:
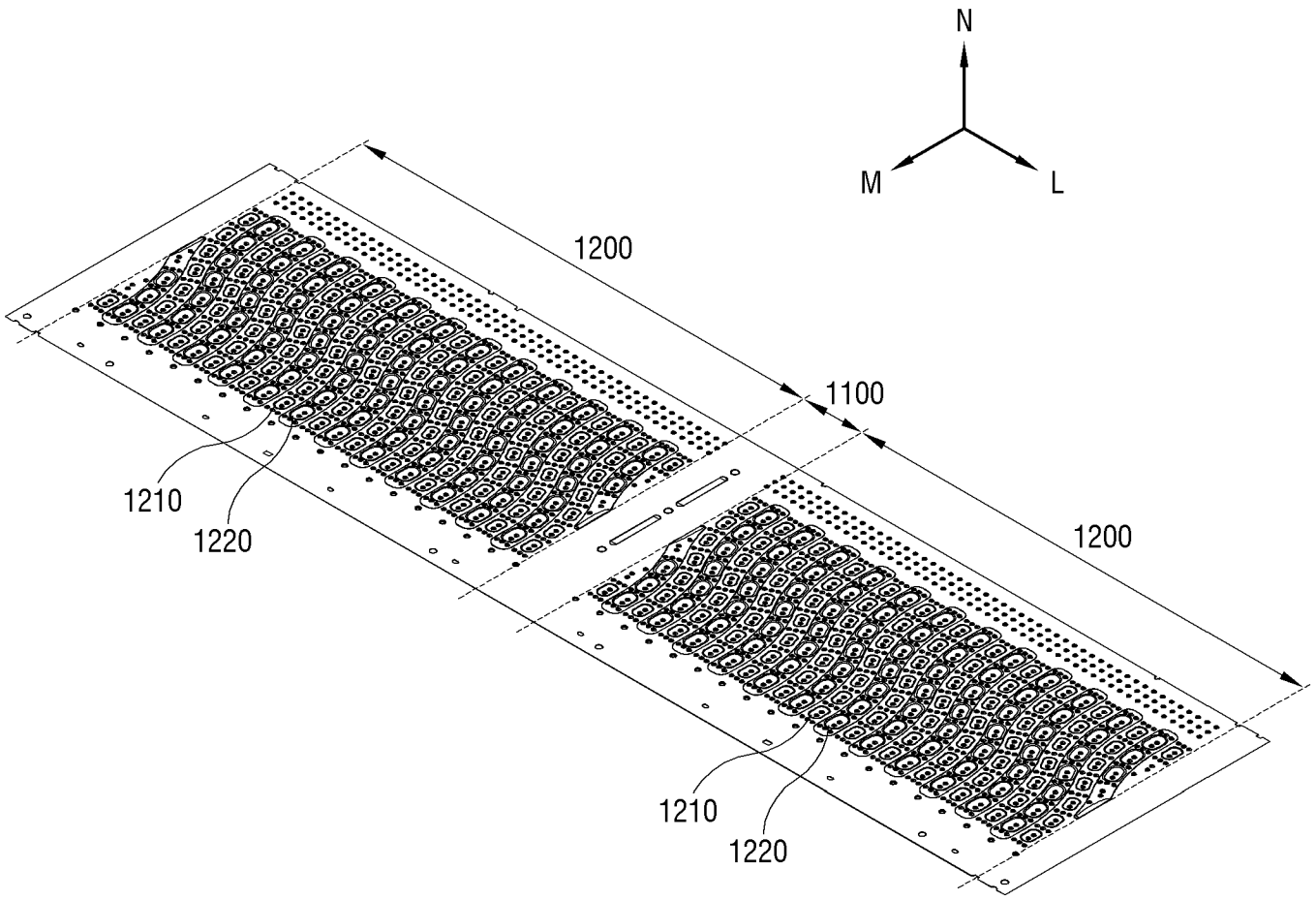
FIG. 4 is a perspective view of an unrolled wrapper.

FIG. 4 is a perspective view of an unrolled wrapper.

As shown in FIG. 4, the wrapper 1000 is embodied by a metal plate extended lengthwise in one direction. FIG. 4 shows three directions of L, M and N, in which the L direction indicates the lengthwise direction of the wrapper 1000, the M direction indicates the widthwise direction of the wrapper, and the N direction indicates a direction from the plate surface of the wrapper 1000 toward the spinning center of a drum the when the wrapper 100 is rolled to form the drum. In other words, the plate surface of the wrapper 1000 in the N direction refers to the inner circumferential surface, and the plate in the −N direction refers to the outer circumferential surface. The wrapper 1000 is rolled so that the plate surface oriented in the N direction can become the inner circumferential surface and its two sides respectively oriented in the L and −L directions can be coupled to each other, and then couples with the rear frame and the front frame at the ends in the M and −M directions, thereby forming the drum.

The wrapper 1000 includes a lifter supporting area 1100 to which the lifter is mounted, and a pattern area 1200 on which the dewatering holes and patterns are together formed. The lifter supporting area 1100 includes a fastening hole for fastening the lifter to the wrapper 1000 by a screw, and a holding hole for supporting a holding end provided in the lifter. The lifter supporting area 1100 is provided between two adjacent pattern areas 1200. The lifter supporting areas 1100 are provided corresponding to the number of lifters to be mounted to the wrapper 1000, but may be designed to correspond to various numbers of one or more lifters.

The pattern area 1200 includes a first pattern 1210 and a second pattern 1220 which are different in shape. In this embodiment, the first pattern 1210 and the second pattern 1220 are alternated one by one along the L direction. However, the respective numbers of the first pattern 1210 and the second pattern 1220 in the pattern area 1200, and the arrangement of the first pattern 1210 and the second pattern 1220 are not limited to those according to this embodiment. Alternatively, the number of first patterns 1210 may not one-to-one correspond to the number of second patterns 1220 in the pattern area 1200, and the first pattern 1210 and the second pattern 1220 may not be alternated. A number ratio between the first pattern 1210 and the second pattern 1220 is based on properties required in the wrapper 1000 or the drum formed by the wrapper 1000. In this regard, details will be described later.

In this embodiment, the pattern area 1200 includes the first pattern 1210 and the second pattern 1220 which are alternately arranged along the L direction. Meanwhile, a column based on the plurality of first pattern 1210 and a column based on the plurality of second pattern 1220 are extended along the B direction. Each column is not straightly extended in the B direction, but biasedly extended toward a spinning direction.

Below, the structure of the first pattern 1210 and the second pattern 1220 will be described.

Figure 5:
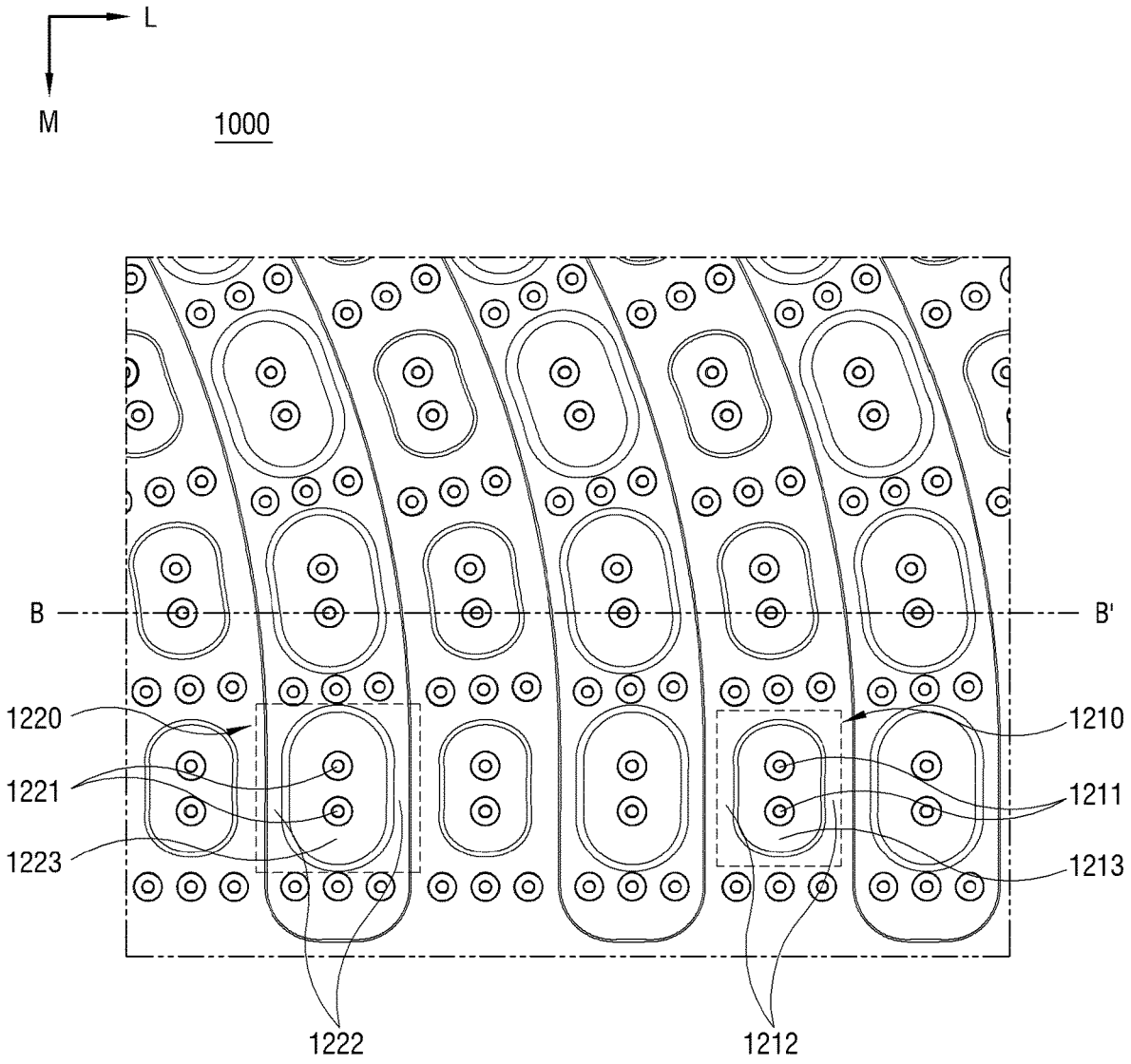
FIG. 5 is a plan view showing an enlarged partial area of the wrapper in FIG. 4.

FIG. 5 is a plan view showing an enlarged partial area of the wrapper in FIG. 4.

Figure 6:
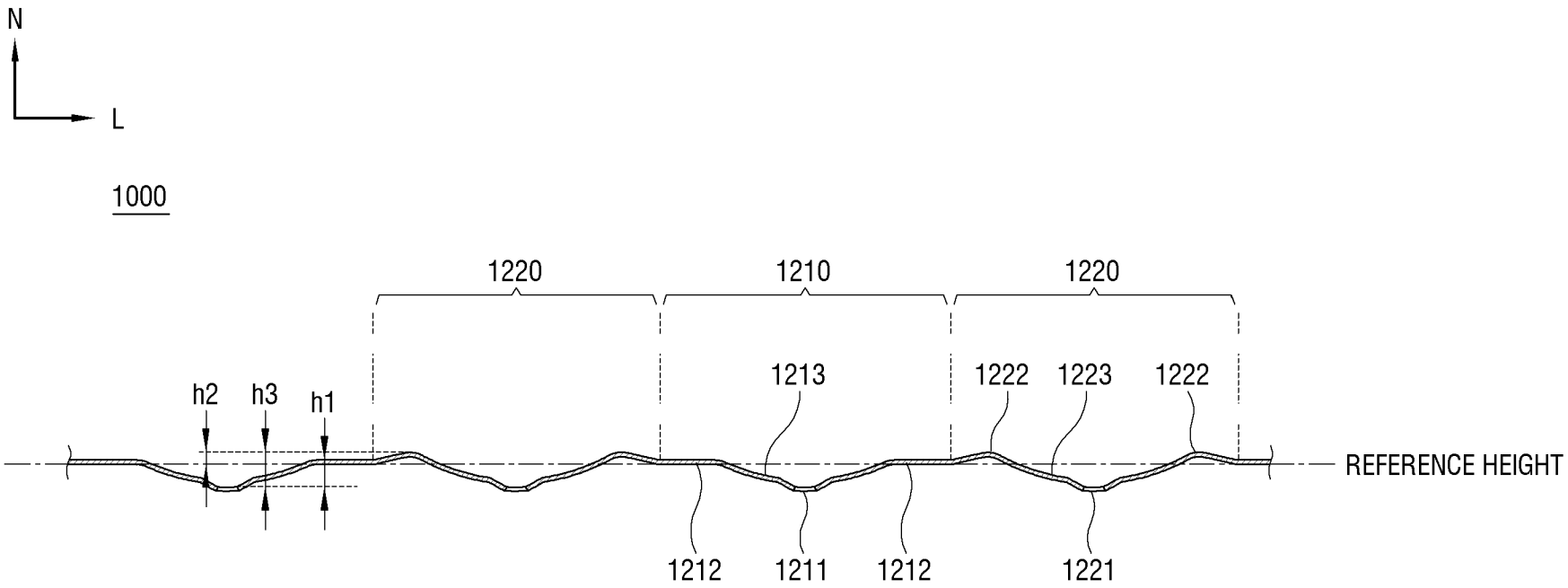
FIG. 6 is a lateral cross-section view, taken along line B-B' in FIG. 5.

FIG. 6 is a lateral cross-section view, taken along line B-B' in FIG. 5.

As shown in FIGS. 5 and 6, the wrapper 1000 includes the first pattern 1210 and the second pattern 1220 which are arranged in the L direction. A height the wrapper 1000 has when it is unrolled flat along the L direction will be called a reference height. The reference height is merely given for convenience of comparison in height between the areas of the wrapper 1000.

The first pattern 1210 includes one or more first dewatering holes 1211 formed for dewatering, even areas 1212 respectively disposed in left and right sides of the first dewatering holes 1211, and a first recess area 1213 recessed between two even areas 1212 and provided with the first dewatering holes 1211.

The first dewatering holes 1211 is formed to discharge water from the inside the drum to the outside when the front-loading washing machine is in the washing process or a dewatering process. In this embodiment, two first dewatering holes 1211 are provided inside the first recess area 1213. However, there are no limits to the number and position of first dewatering holes 1211 provided inside the first recess area 1213. Nevertheless, the positions of the first dewatering holes 1211 may be provided in consideration of the dewatering effects of the first recess area 1213. In this regard, details will be described later in relation to the first recess area 1213.

The even areas 1212 are extended in parallel with the axis line of the L direction. The reference height is substantially the same as the height of the even area 1212. The even area 1212 refers to an even area without curvature in the wrapper 1000, and functions to reinforce the rigidity of the wrapper 1000. Therefore, when the wrapper 1000 has a uniform thickness, the rigidity of the wrapper 1000 increases as the even area 1212 becomes longer. However, the structure of the even area 1212 lowers the washing efficiency, and therefore a separate structure for enhancing the washing efficiency is applied to the wrapper 1000. In this regard, details will be described later.

In this embodiment, the plurality of even areas 1212 are provided at the left and right sides of the first dewatering holes 1211 in the first pattern 1210, but not necessarily limited to this structure. For example, the even area 1212 may be provided at only one of the left and right sides of the first dewatering holes 1211 inside the first pattern 1210.

On the contrary to the even area 1212, the first recess area 1213 is recessed to be lower than the reference height in the first pattern 1210. The first dewatering holes 1211 are formed in a center area, i.e. the deepest area of the first recess area 1213 with respect to the reference height inside the first recess area 1213. Here, the first recess area 1213 is recessed as much as a height h1 in the −N direction. Because the N direction is oriented toward the spinning center of the drum, the first recess area 1213 is recessed in the outer circumferential direction of the drum.

The reason why the first dewatering holes 1211 are formed in the first recess area 1213 is as follows. When the drum spins in the dewatering process of the front-loading washing machine, water in the drum is pushed toward the inner circumferential surface of the drum by centrifugal force from the spinning. At this time, the first recess area 1213 accommodates water of which the amount corresponds to the recessed depth. The deeper the first recess area 1213 is recessed, the more the water is accommodated. The first dewatering holes 1211 are positioned at the deepest position (i.e. the farthest position from the reference height) of the first recess area 1213, so that water accommodated in the first recess area 1213 can be easily discharged to the outside of the drum. In other words, the higher the value of the height h1, the more the amount of water discharged through the first dewatering holes 1211 during the dewatering process.

The second pattern 1220 includes one or more second dewatering holes 1221 formed for dewatering, uneven areas 1222 respectively disposed in left and right sides of the second dewatering holes 1221, and a second recess area 1223 recessed between two uneven areas 1222 and provided with the second dewatering hole 1221.

The second dewatering hole 1221 serves to discharge water from the inside of the drum to the outside, like the first dewatering holes 1211. There are no limits to the number and position of second dewatering holes 1221 provided inside the second recess area 1223.

The uneven area 1222 refers to a curved area which has lower flatness than the even area 1212. In this embodiment, the uneven area 1222 is an area protruding in the N direction, i.e. an area protruding toward the inner circumferential surface of the drum. Such a shape of the uneven area 1222 improves a washing efficiency in the washing process. Further, the position of the uneven area 1222 adjacent to the second recess area 1223 improves a dewatering efficiency, and details thereof will be described later.

The second recess area 1223 is recessed to be lower than the reference height in the second pattern 1220. The second dewatering holes 1221 are formed in a center area, i.e. the deepest area of the second recess area 1223 with respect to the reference height inside the second recess area 1223. Here, the recessed depth of the second recess area 1223 may be equal to or different from the recessed depth of the first recess area 1213. In this embodiment, it will be described on the assumption that the second recess area 1223 and the first recess area 1213 have the same recessed depth. In other words, the second recess area 1223 is recessed as much as a height h1 in the −N direction. When only the second recess area 1223 is taken into account, the second recess area 1223 has the same dewatering effect as the first recess area 1213.

However, the dewatering effect of the second recess area 1223 may be more improved than the dewatering effect of the first dewatering hole 1211 by the uneven area 1222 adjacent to the second recess area 1223. For example, it will be assumed that the diameter of the first dewatering hole 1211 is equal to the diameter of the second dewatering hole 1221, the recessed depth the first recess area 1213 from the reference height is equal to the recessed depth h1 of the second recess area 1223 from the reference height, and the uneven area 1222 has a height h2 from the reference height.

In a case of the first pattern 1210, the even area 1212 does not serve to substantially accommodate water while the drum is spinning. Therefore, throughout the first pattern 1210, the accommodating space of the first pattern 1210 for accommodating water has a height h1. On the other hand, the accommodating space of the second pattern 1220 for accommodating water starts from the protruding portion of the uneven area 1222 because the uneven area 1222 is adjacent to the second recess area 1223. Therefore, throughout the second pattern 1220, the height of the accommodating space for accommodating water is obtained by h1+h2=h3. Like this, the second pattern 1220 shows a more improve dewatering effect than the first pattern 1210.

As described above, the first pattern 1210 including the even area 1212 improves the rigidity of the wrapper 1000, and the second pattern 1220 including the uneven area 1222 improves the washing efficiency and the dewatering efficiency of the drum. The wrapper 1000 with the first pattern 1210 and the second pattern 1220 improves the rigidity of the wrapper 1000 while securing the washing efficiency and the dewatering efficiency. With the improved rigidity of the wrapper 1000, the wrapper 100 is improved in resistance against a shock caused by water or laundry while the drum is spinning, and is prevented from deformation.

In this embodiment, the first pattern 1210 and the second pattern 1220 are provided in the wrapper 1000 at an approximately 1:1 ratio. However, this ratio may be variously designed. For example, when the rigidity is guaranteed by the material of the wrapper 1000, the percentage of the first pattern 1210 may be decreased and the percentage of the second pattern 1220 may be increased in the wrapper 1000. Alternatively, when the wrapper 1000 required to have higher rigidity, the percentage of the first pattern 1210 may be relatively increased in the wrapper 1000.

When a specific area of the whole wrapper 1000 is required to have relatively high rigidity while the drum is spinning, the corresponding area may be relatively increased in the percentage of the first pattern 1210 and decreased in the percentage of the second pattern 1220, but the other area may be relatively increased in the percentage of the second pattern 1220.

Like this, the first pattern 1210 and the second pattern 1220 on the wrapper 1000 may be variously designed according to the properties required in the drum.

Meanwhile, the wrapper may include various dewatering holes as well as the first dewatering holes 1211 provided in the first pattern 1210 and the second dewatering holes 1221 provided in the second pattern 1220. For example, the wrapper 1000 may further include one or more third dewatering holes 1230 spaced apart from the first dewatering holes 1211 or the second dewatering holes 1221 in the M direction, i.e. in a direction parallel with the spinning axis of the drum.

The third dewatering holes 1230 are provided between two adjacent first patterns 1210 or between two adjacent second patterns 1220 along the M direction. In the wrapper 1000, an area where the third dewatering holes 1230 are arranged is the area of the reference height. Under the condition that the rigidity of the wrapper 1000 is guaranteed by the first pattern 1210, the wrapper 1000 may additionally include the third dewatering holes 1230 to thereby improve the dewatering efficiency.

Further, additional dewatering holes may also be provided between the first pattern 1210 and the second pattern 1220, details of which will be described below.

Figure 7:
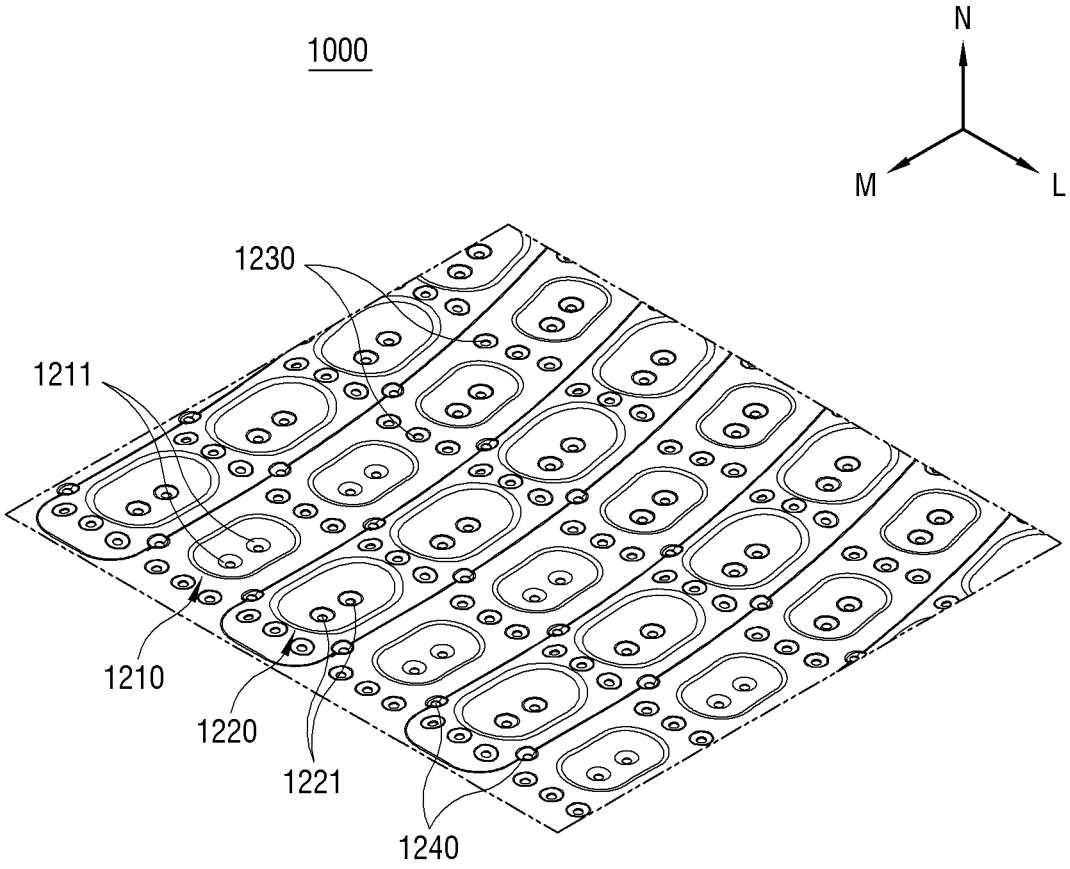
FIG. 7 is a partial perspective view of a wrapper.

FIG. 7 is a partial perspective view of a wrapper.

Figure 8:
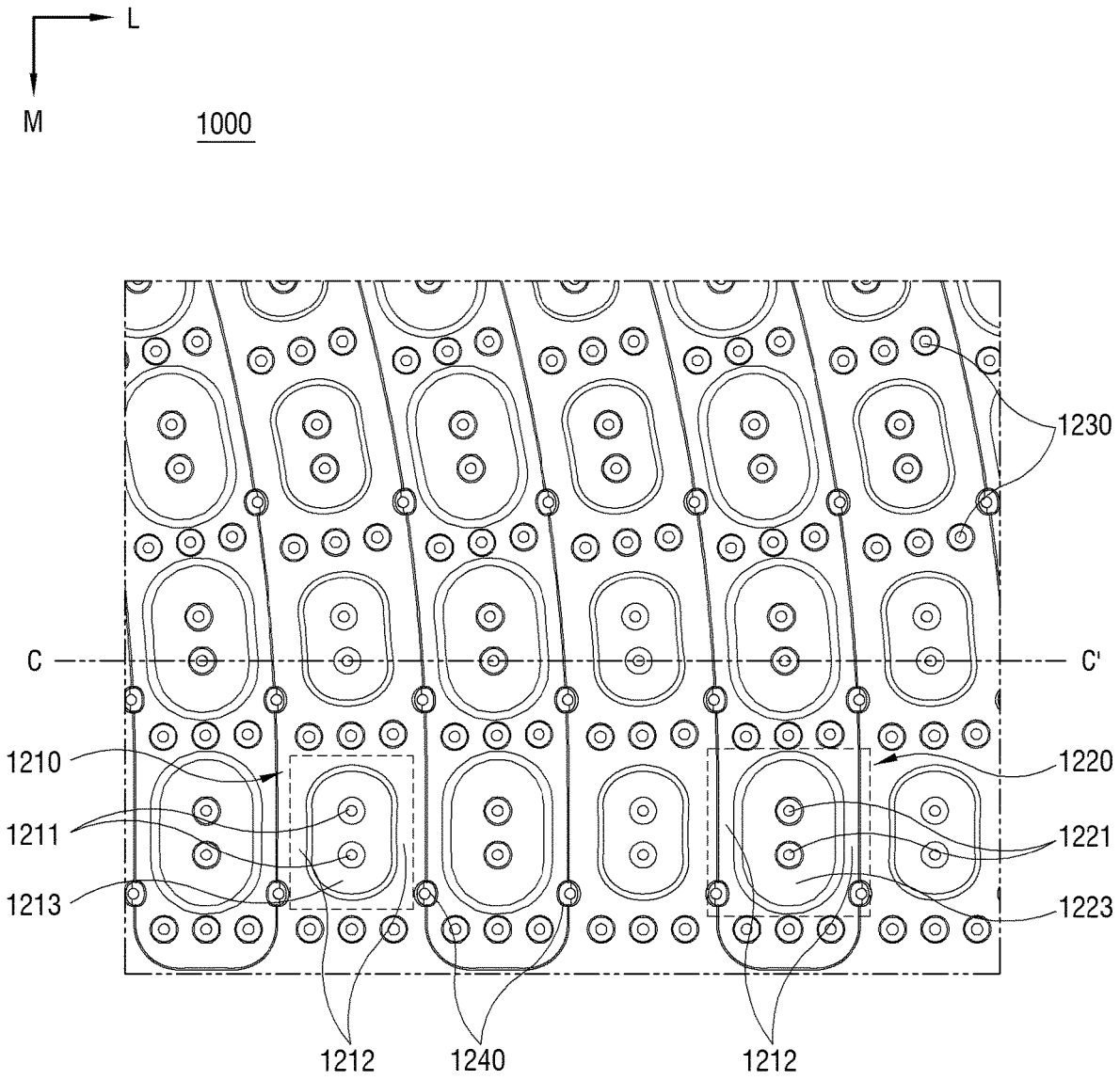
FIG. 8 is a plan view of FIG. 7.

FIG. 8 is a plan view of FIG. 7.

Figure 9:
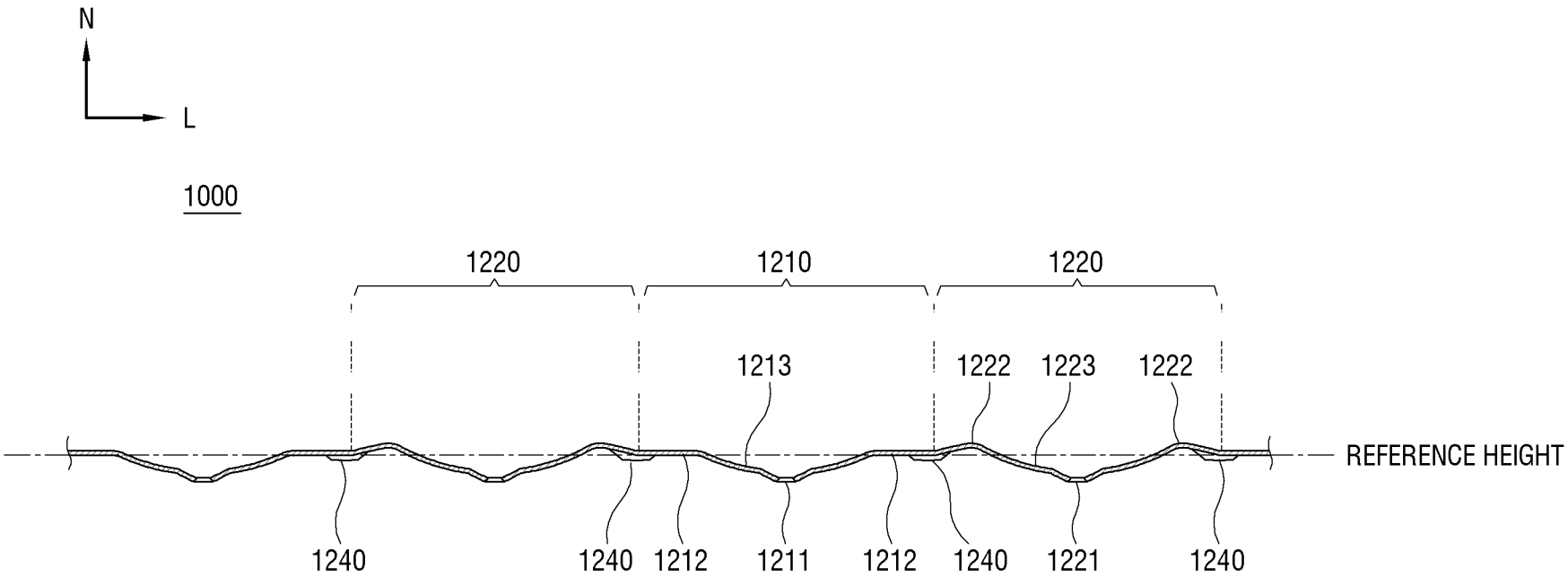
FIG. 9 is a lateral cross-section view, taken along line C-C' in FIG. 8.

FIG. 9 is a lateral cross-section view, taken along line C-C' in FIG. 8.

As shown in FIGS. 7, 8 and 9, the wrapper 1000 includes the first pattern 1210 and the second pattern 1220. The first pattern 1210 includes the first dewatering hole 1211, the even area 1212, and the first recess area 1213. The second pattern 1220 includes the second dewatering hole 1221, the uneven area 1222, and the second recess area 1223. Further, the wrapper 1000 may further include the third dewatering hole 1230. These elements are the same as described above in the foregoing embodiments, and therefore repetitive descriptions thereof will be avoided.

In this embodiment, the wrapper 1000 may further include a fourth dewatering hole 1240 provided between the first pattern 1210 and the second pattern 1220 which are adjacent to each other. The first pattern 1210 includes the even areas 1212 arranged at the left and right sides of the first recess area 1213 where the first dewatering holes 1211 are positioned, and the second pattern 1220 includes the uneven areas 1222 arranged at the left and right sides of the second recess area 1223 where the second dewatering hole 1221 are positioned. Therefore, the even area 1212 and the uneven area 1222 are adjacent to each other, and the fourth dewatering hole 1240 is provided between the even area 1212 and the uneven area 1222 which are adjacent to each other.

A space between the even area 1212 and the uneven area 1222 is relatively narrower than the first recess area 1213 or the second recess area 1223, but forms an area in which water can be accommodated while the drum is spinning. The fourth dewatering hole 1240 is provided in such an area to thereby enhance the dewatering efficiency.

Meanwhile, the foregoing embodiments show a structure that the dewatering holes are provided in the recessed areas of the patterns. However, another structure may also be designed, and an embodiment thereof will be described below.

Figure 10:
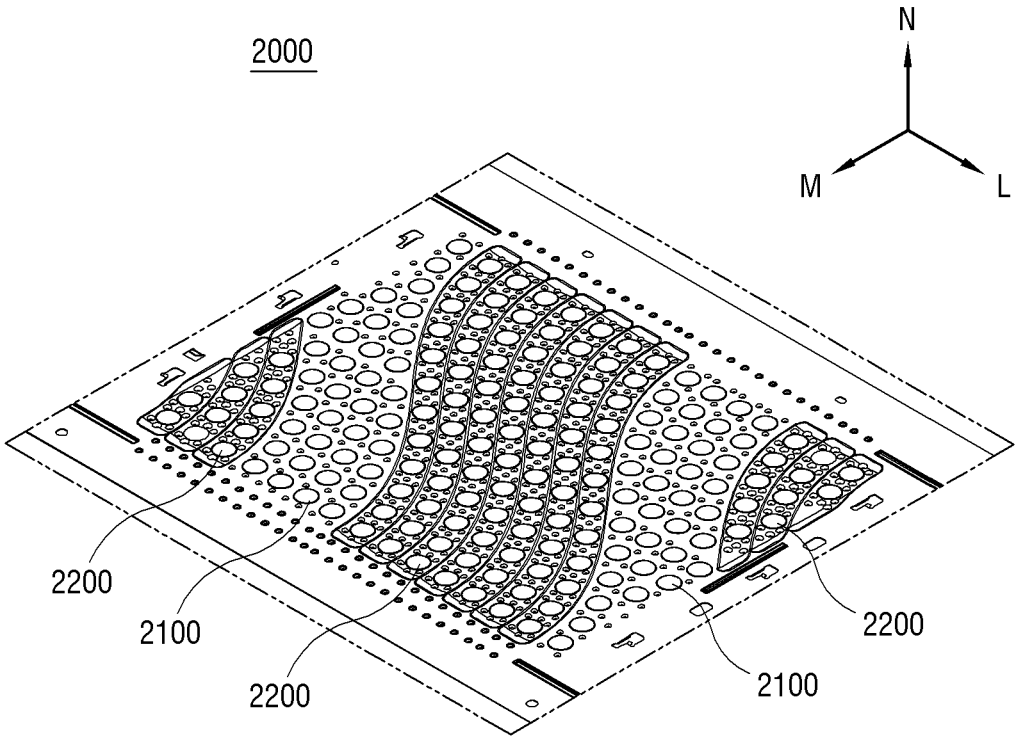
FIG. 10 is a partial perspective view of a wrapper.

FIG. 10 is a partial perspective view of a wrapper.

Figure 11:
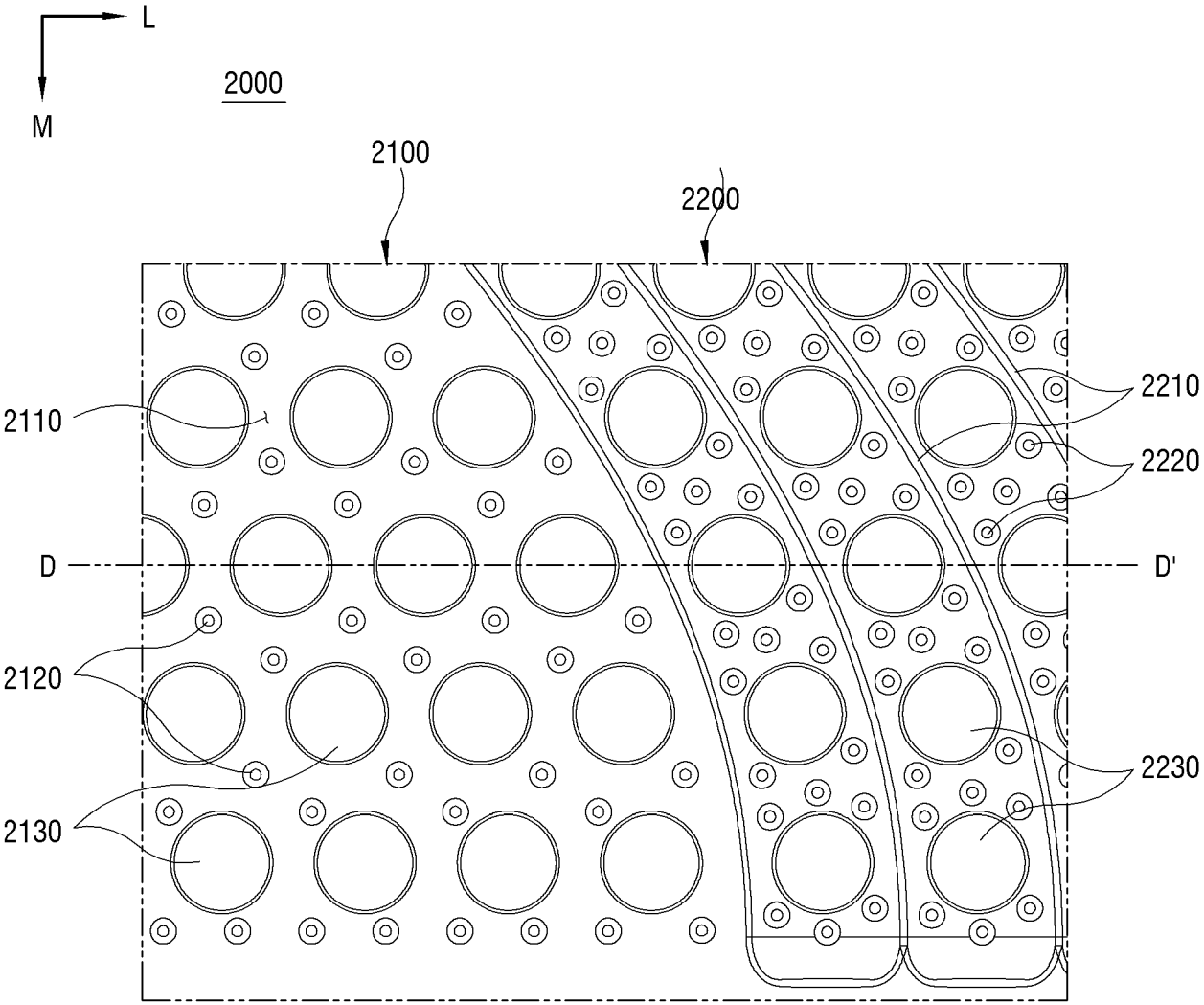
FIG. 11 is a partial plan view of FIG. 10.

FIG. 11 is a partial plan view of FIG. 10.

Figure 12:
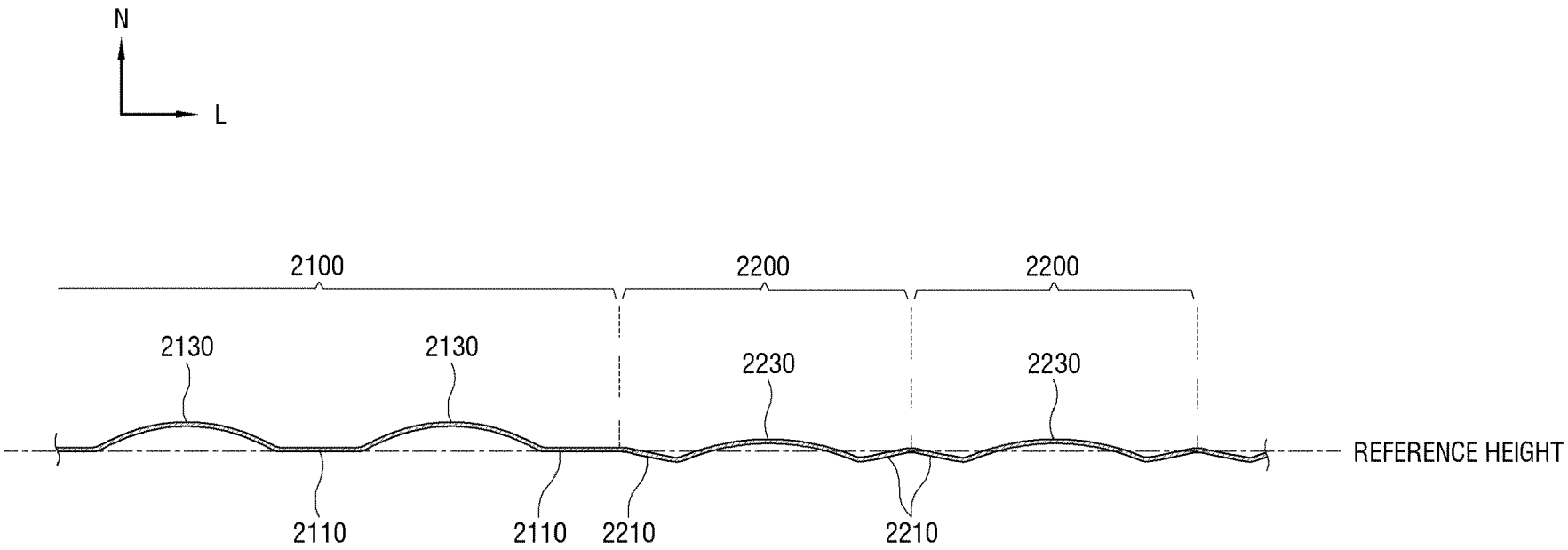
FIG. 12 is a lateral cross-section view, taken along line D-D' in FIG. 11.

FIG. 12 is a lateral cross-section view, taken along line D-D' in FIG. 11.

As shown in FIGS. 10, 11 and 12, a wrapper 2000 includes a first pattern 2100 and a second pattern 2200. A height the wrapper 2000 has when it unrolled flat along the L direction will be called a reference height. Like the foregoing embodiments, the reference height is merely given for convenience of comparison in height between the areas of the wrapper 2000.

The first pattern 2100 includes an even area 2110, a plurality of first dewatering holes 2120 formed on the even area 2110, and a plurality of first protrusions 2130 protruding from the even area 2110 toward the spinning center of the drum. Meanwhile, the second pattern 2200 includes an uneven area 2210, a plurality of second dewatering holes 2220 formed on the uneven area 2210, and a plurality of second protrusions 2230 protruding from the uneven area 2210 toward the spinning center of the drum. In this embodiment, the wrapper 2000 is divided by not the alternate arrangement of the first pattern 2100 and the second pattern 2200 but an area where the plurality of first patterns 2100 are grouped and an area where the plurality of second patterns 2200 are grouped. However, this is merely one example of design methods, and the first pattern 2100 and the second pattern 2200 may be alternately arranged one by one or per a plurality of patterns like those of the foregoing embodiments.

The even areas 2110 are extended in parallel with the axis line of the L direction. The height of the even area 2110 is substantially the same as the reference height. The even area 2110 refers to an even area without curvature in the wrapper 2000, and functions to reinforce the rigidity of the wrapper 2000.

The first dewatering hole 2120 is formed in the even area 2110 so that water in the drum can be discharged to the outside of the drum. The even area 2110 is formed around the first protrusion 2130, thereby forming an area for accommodating water between the plurality of first protrusions 2130 adjacent to each other while the drum is spinning. The first dewatering hole 2120 is provided in such an area, so that water can be easily discharged.

The first protrusion 2130 protrudes from the inner circumferential surface of the drum toward the spinning center of the drum, thereby having an improved efficiency of washing laundry. Further, the plurality of first protrusions 2130 are higher than the even area 2110 so as to form the area for accommodating water in the surrounding even areas 2110, thereby improving the dewatering efficiency.

The uneven areas 2210 are arranged at the left and right sides of the second protrusion 2230 inside the second pattern 2200 (see FIG. 12). The uneven area 2210 is inclined down from the reference height toward the second protrusion 2230. For example, the uneven area 2210 provided at the left side of the second protrusion 2230 is extended down from the reference height toward the left edge of second protrusion 2230, and the uneven area 2210 provided at the right side of the second protrusion 2230 is extended down from the reference height toward the right edge of the second protrusion 2230.

Such a structure of the uneven area 2210 forms an area for accommodating water therein while the drum is spinning. This area accommodates more water than the area formed by the first protrusion 2130 and the even area 2110 in the first pattern 2100.

The second dewatering hole 2220 is formed in the uneven area 2210 so that water accommodated in the area formed by the uneven area 2210 can be discharged to the outside of the drum while the drum is spinning.

The second protrusion 2230 protrudes from the inner circumferential surface of the drum toward the spinning center of the drum, thereby improving an efficiency of washing laundry. Further, the second protrusion 2230 is higher than the uneven area 2210 so as to form an area for accommodating water in the surrounding uneven areas 2210, thereby enhancing the dewatering efficiency.

Meanwhile, the foregoing embodiments show that the wrapper includes the first pattern with the even area to reinforce the rigidity of the wrapper, and the second patter with the uneven area to improve the dewatering efficiency of the drum. However, the wrapper may include only the second pattern under the condition that the rigidity of the wrapper is sufficiently guaranteed. Such an embodiment will be described.

Figure 13:
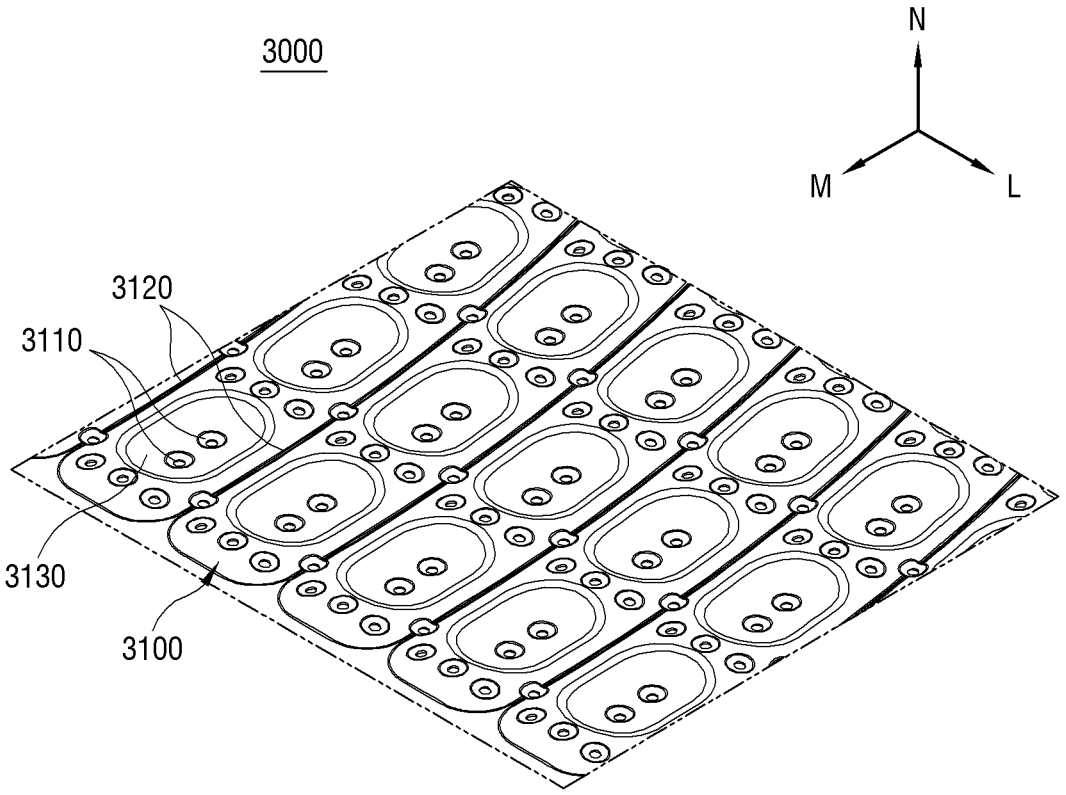
FIG. 13 is a partial perspective view of a wrapper.

FIG. 13 is a partial perspective view of a wrapper.

Figure 14:
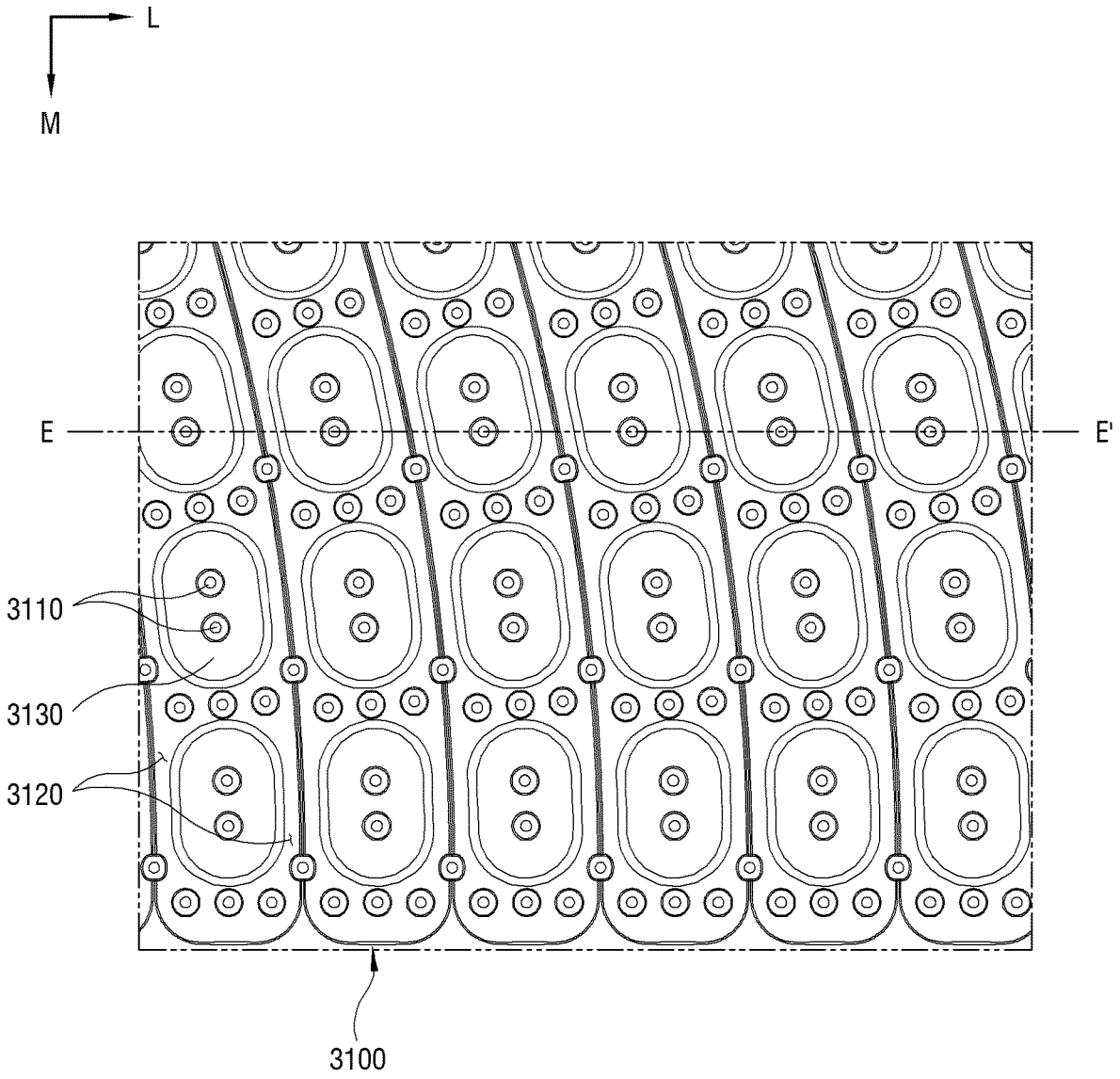
FIG. 14 is a partial plan view of FIG. 13.

FIG. 14 is a partial plan view of FIG. 13.

Figure 15:
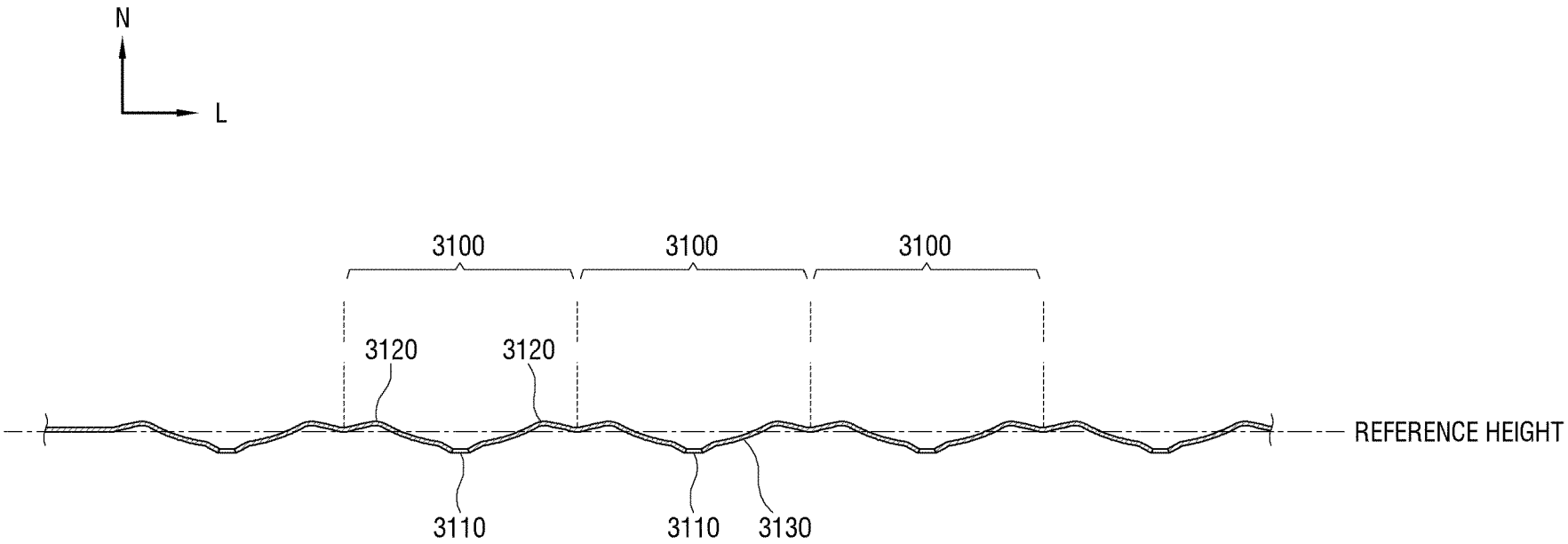
FIG. 15 is a lateral cross-section view, taken along line E-E' in FIG. 14.

FIG. 15 is a lateral cross-section view, taken along line E-E' in FIG. 14.

As shown in FIGS. 13, 14 and 15, a wrapper 3000 includes a plurality of unit patterns 3100. A height the wrapper 3000 has when it is unrolled flat along the L direction will be called a reference height. Like the foregoing embodiments, the reference height is merely given for convenience of comparison in height between the areas of the wrapper 3000.

The pattern 3100 includes a plurality of dewatering holes 3110 formed for dewatering, uneven areas 3120 arranged at left and right sides of the dewatering holes 3110, and a recess area 3130 recessed between two uneven areas 3120 and formed with the second dewatering holes 3110.

The dewatering hole 3110 serves to discharge water from the inside of the drum to the outside of the drum. There are no limits to the number and position of dewatering holes 3110 provided in the recess area 3130.

The uneven areas 3120 refers to a curved area, for example, an area protruding in the N direction, i.e. an area protruding toward the inner circumferential surface of the drum. Such a shape of the uneven area 3120 improves the washing efficiency in the washing process. Further, the position of the uneven area 3120 adjacent to the second recess area 3130 improves the dewatering efficiency.

The recess area 3130 is recessed to be lower than the reference height in the pattern 3100. The dewatering holes 3110 are formed in a center area, i.e. the deepest area of the recess area 3130 with respect to the reference height. The dewatering effect of the recess area 3130 may be more improved by the uneven area 3120 adjacent to the recess area 3130. The descriptions in this regard are substantially the same as those of the foregoing embodiments, and therefore repetitive descriptions thereof will be avoided.

Meanwhile, the foregoing embodiments show that the wrapper is applied to the drum of the front-loading washing apparatus such as a front-loading washing machine, a front-loading drying machine, etc. However, the wrapper with the structure according to an embodiment of the disclosure may also be applied to a top-loading washing apparatus. Below, such an embodiment will be described.

Figure 16:
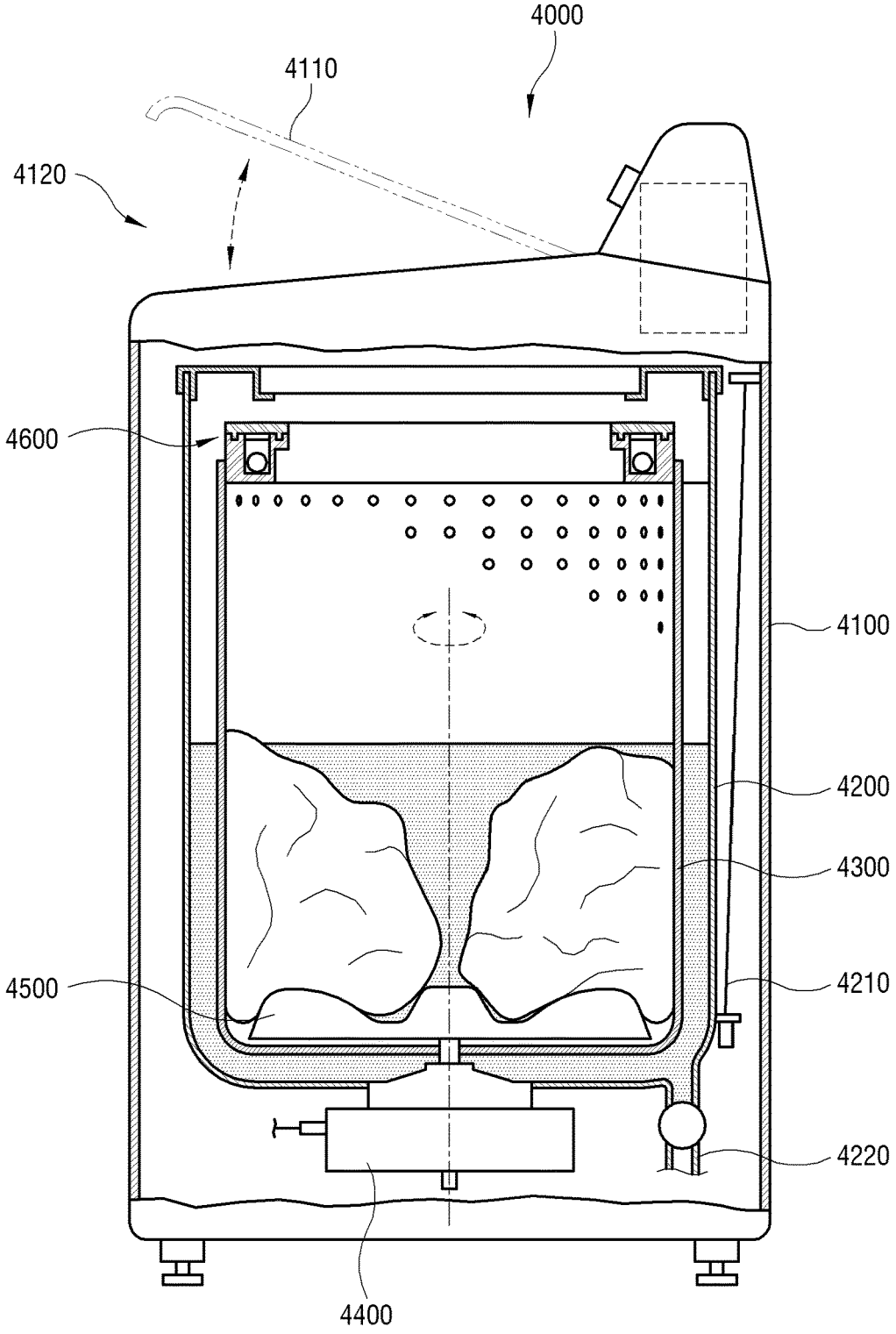
FIG. 16 is a lateral cross-section view of a top-loading washing machine.

FIG. 16 is a lateral cross-section view of a top-loading washing machine.

As shown in FIG. 16, a washing apparatus 4000 according to this embodiment includes a top-loading washing machine. The washing apparatus 4000 includes a housing 4100, and a loading hole 4120 formed on the top of the housing 4100 and opened and closed by a cover 4110 so that laundry can be loaded into the housing 4100 through the loading hole 4120. Further, the washing apparatus 4000 includes a water tank 4200, a washing tub 4300, a motor 4400, a pulsator 4500, and a balancer 4600 inside the housing 4100.

The water tank 4200 refers to a cylindrical tank with a bottom to keep water in store, and is supported inside the housing 4100 by a plurality of suspensions 4210 with a top opening aligned with the loading hole 4120. The water tank 4200 can be filled with water by a water supplier. A drain pipe 4220, which is controlled to be opened or closed by a valve, is connected to a lower portion of the water tank 4200, and therefore water in the water tank 4200 is discharged to the outside of the housing 4100 through the drain pipe 4220.

The washing tub 4300 is shaped like a cylinder and accommodated in the water tank 4200, thereby loading laundry therein. The washing tub 4300 is driven by the motor 4400 to spin with respect to a spinning shaft vertically extended toward the loading hole 4120.

The motor 4400 generates driving power for driving the washing tub 4300 and the pulsator 4500. The motor 4400 drives the washing tub 4300 and the pulsator 4500 to spin while reversing a spinning direction in a predetermined cycle, thereby agitating laundry with water and detergent. The motor 4400 drives the pulsator 4500 and the washing tub 4300 to spin at high speed in a certain direction as synchronized in the dewatering process, and dewatering is carried out by pushing laundry toward the inner circumferential surface of the washing tub 4300 based on centrifugal force.

The pulsator 4500 is installed in the bottom of the washing tub 4300, and shaped like a disc with agitating blades on the top thereof. The pulsator 4500 is provided to spin based on the driving power of the motor 4400.

The balancer 4600 is installed in the opening of the washing tub 4300. The balancer 4600 is a ring-shaped member accommodating a plurality of bearings or viscous liquid therein, and controls unbalanced weight caused by eccentric laundry while the washing tub 4300 is spinning.

The washing tub 4300 according to this embodiment employs a wrapper as described above in the foregoing embodiments. Such a wrapper is substantially the same as those of the foregoing embodiments, and therefore repetitive descriptions thereof will be avoided.

Although a few embodiments have been shown and described, it will be appreciated by those skilled in the art that changes may be made in these embodiments without departing from the principles and spirit of the embodiments, the scope of which is defined in the appended claims and their equivalents.

What is claimed is:

1. A drum-type washing apparatus comprising:

a housing having an opening in a front of the housing;

a washing tub, having a cylindrical shape, supported to spin inside the housing and arranged to receive laundry through the opening; and a door to open and close the opening, wherein washing tub has a first pattern on an inner circumferential surface of the washing tub, and including an even area, a recessed area adjacent to the even area and recessed with respect to the even area, and a dewatering hole in the recessed area, and a second pattern on the inner circumferential surface of the washing tub, and including an uneven area, a recessed area adjacent to the uneven area and recessed with respect to the uneven area, and a dewatering hole in the recessed area.

2. The drum-type washing apparatus according to claim 1, wherein the even area of the first pattern surrounds the recessed area of the first pattern.

3. The drum-type washing apparatus according to claim 1, wherein at least one of the following is satisfied:

the first pattern includes a plurality of dewatering holes in the recessed area of the first pattern, and that are arranged along a direction that is parallel with a spinning axis of the washing tub, and the second pattern includes a plurality of dewatering holes in the recessed area of the second pattern, and that are arranged along the direction that is parallel with the spinning axis of the washing tub.

4. The drum-type washing apparatus according to claim 1, wherein the uneven area protrudes from the inner circumferential surface of the washing tub toward a spinning axis of the washing tub.

5. The drum-type washing apparatus according to claim 1, wherein the uneven area protrudes from the inner circumferential surface of the washing tub so as to be closer to a spinning axis of the washing tub than the even area is to the spinning axis of the washing tub.

6. The drum-type washing apparatus according to claim 1, wherein the first pattern and the second pattern are alternately arranged along the inner circumferential surface of the washing tub.

7. The drum-type washing apparatus according to claim 1, wherein at least one of the following is satisfied:

a plurality of the first patterns are arranged on the inner circumferential surface of the washing tub along a direction that is parallel with a spinning axis of the washing tub, and a plurality of the second patterns are arranged on the inner circumferential surface of the washing tub along the direction that is parallel with the spinning axis of the washing tub.

8. The drum-type washing apparatus according to claim 1, wherein at least one of the following is satisfied:

a plurality of the first patterns are arranged on the inner circumferential surface of the washing tub in a column, and a plurality of the second patterns are arranged on the inner circumferential surface of the washing tub in a column.

9. The drum-type washing apparatus according to claim 1, further comprising a dewatering hole spaced apart from the dewatering hole of the first pattern and the dewatering hole of the second pattern in a direction parallel with a spinning axis of the washing tub.

10. The drum-type washing apparatus according to claim 1, wherein the even area and the uneven area are adjacent to each other.

11. The drum-type washing apparatus according to claim 10, further comprising a dewatering hole between the even area of the first pattern and the uneven area of the second pattern.

12. The drum-type washing apparatus according to claim 1, wherein at least one of the following is satisfied:

the even area includes first and second even areas at opposite sides of the dewatering hole of the first pattern, and the uneven area includes first and second uneven areas at opposite sides of the dewatering hole of the second pattern.

13. A drum-type washing apparatus comprising:

a housing having an opening in a front of the housing;

a washing tub, having a cylindrical shape, supported to spin inside the housing and arranged to receive laundry through the opening; and a door to open and close the opening, wherein washing tub has a first pattern on an inner circumferential surface of the washing tub, and including an even area and a plurality of dewatering holes in the even area, and a second pattern on the inner circumferential surface of the washing tub, and including an uneven area and a plurality of dewatering holes in the uneven area.

14. The drum-type washing apparatus according to claim 13, wherein the first pattern includes a plurality of protrusions surrounded by the even area, and the second pattern includes a plurality of protrusions bounded by the uneven area.

15. The drum-type washing apparatus according to claim 14, wherein the plurality of protrusions of the first pattern are arranged in a column, and the plurality of protrusions of the second pattern are arranged in a column.

16. A drum-type washing apparatus comprising:

a housing having an opening in a front of the housing;

a washing tub, having a cylindrical shape, supported to spin inside the housing and arranged to receive laundry through the opening; and a door configured to open and close the opening, wherein the washing tub has a plurality of unit patterns repeatedly located along a circumferential direction of the washing tub on an inner circumferential surface of the washing tub, each unit pattern including a first uneven area, a second uneven area, a first recessed area between the first uneven area and the second uneven area and recessed with respect to the first uneven area and the second uneven area, and a dewatering hole in the first recessed area, and wherein for each two unit patterns of the plurality of unit patterns that are adjacent to each other, a second recessed area having a depth different from a depth of the first recessed area is located between the two unit patterns.

17. The drum-type washing apparatus according to claim 16, wherein the plurality of unit patterns are arranged in a column.

18. The drum-type washing apparatus according to claim 17, wherein the first uneven area and the second uneven area extend in a column direction of the column.

* * * * *